United States Patent [19]

Moran

[11] 4,090,812

[45] May 23, 1978

[54] AXIAL FAN WITH AUTOMATICALLY CONTROLLED VARIABLE PITCH BLADES

[75] Inventor: David D. Moran, Silver Spring, Md.

[73] Assignee: The United States of America as represented by the Secretary of the Navy, Washington, D.C.

[21] Appl. No.: 743,367

[22] Filed: Nov. 19, 1976

[51] Int. Cl.[2] ..... B63H 3/00

[52] U.S. Cl. ..... 416/133; 416/150; 416/161

[58] Field of Search ..... 416/133, 161, 149, 150

[56] References Cited

U.S. PATENT DOCUMENTS

| | | | |
|---|---|---|---|
| 30,848 | 12/1860 | Wentworth | 416/133 |
| 1,882,410 | 10/1932 | Crumback | 416/133 |
| 1,952,798 | 3/1934 | Havill | 416/133 |
| 2,118,201 | 5/1938 | Hood | 416/133 |
| 2,292,147 | 8/1942 | Miller | 416/133 |
| 2,468,004 | 4/1949 | Walker | 416/133 |
| 2,594,160 | 4/1952 | Hansson | 416/133 |

FOREIGN PATENT DOCUMENTS

| | | | |
|---|---|---|---|
| 448,239 | 5/1948 | Canada | 416/133 |
| 311,472 | 5/1929 | United Kingdom | 416/133 |

*Primary Examiner*—Everette A. Powell, Jr.
*Attorney, Agent, or Firm*—R. S. Sciascia; Q. E. Hodges

[57] ABSTRACT

A fan impeller for axial flow having automatically variable-pitch blades attached to a rotatable hub for attaining maximum lift and inhibiting stall in a varying back pressure regime. The blades are attached for rotation about their axes to the hub, and are connected through a crank and link to a drive shaft. The hub is attached to the drive shaft to permit relative axial movement, but to preclude relative rotational movement. Varying back pressure moves the blades and the hub in variable blade rotation planes, causing changes in blade pitch. Springs and dash-pots, connecting the hub and shaft, act axially to give non-linear restoring forces and damping to the blade pitch changes.

3 Claims, 4 Drawing Figures

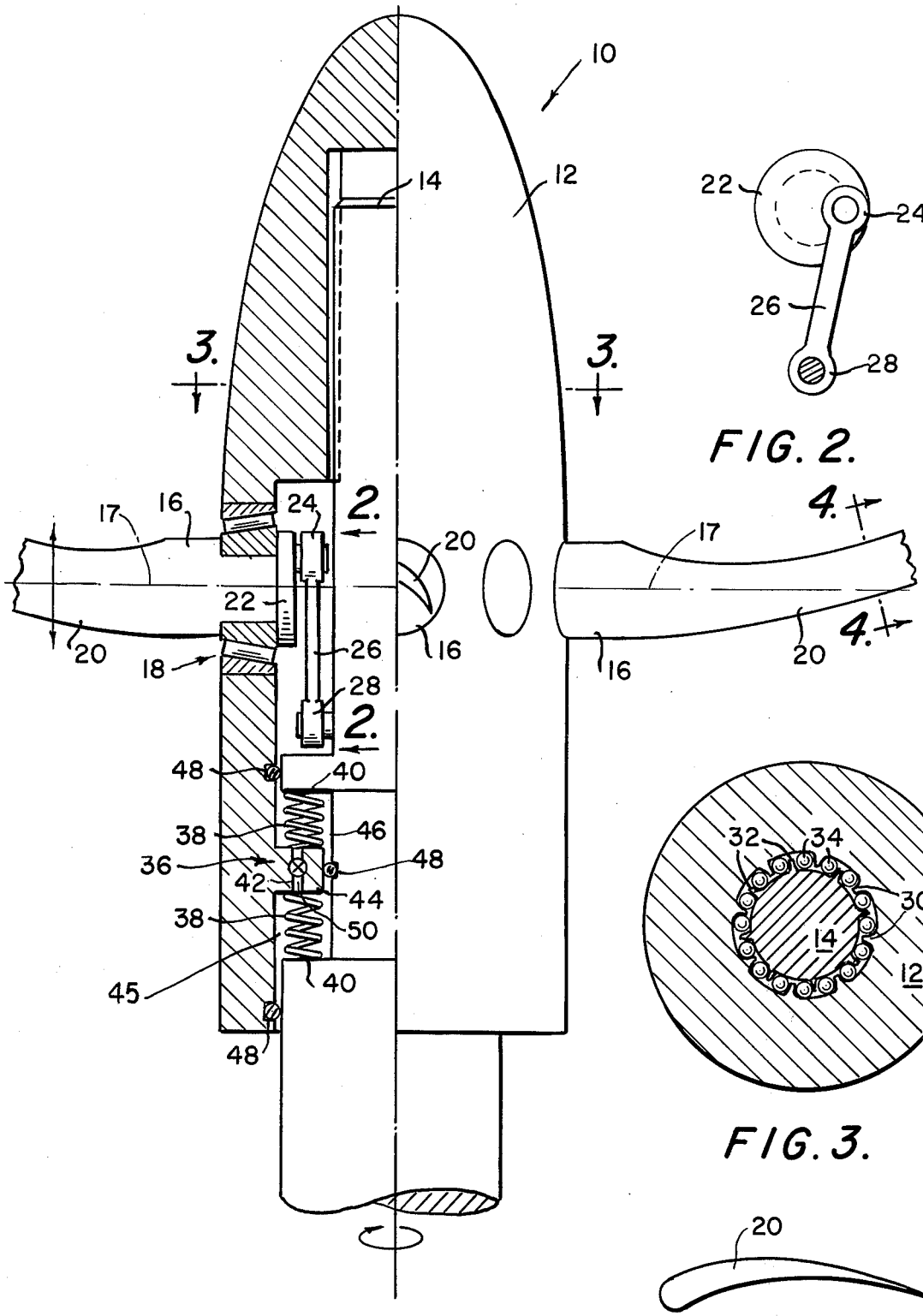
FIG. 1.
FIG. 2.
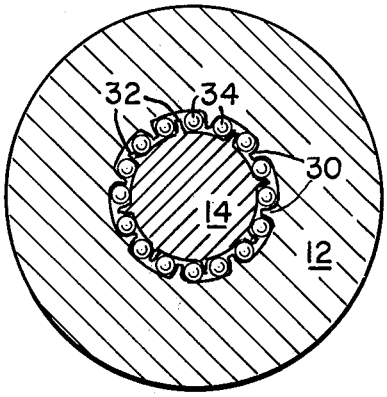
FIG. 3.
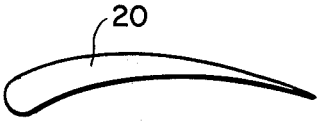
FIG. 4.

AXIAL FAN WITH AUTOMATICALLY CONTROLLED VARIABLE PITCH BLADES

The invention described herein may be manufactured and used by or for the Government of the United States of America for governmental purposes without the payment of any royalties thereon or therefor.

BACKGROUND OF THE INVENTION

This invention relates generally to axial impeller, and more particularly to automatically controlled variable pitch blade impellers that may be used for example in unsteady back pressure and discharge flow regimes.

Many axial fan systems are subject to large variations in the amplitude of back pressure and therefore, fan discharge flow rate. Prior art designs generally employ fixed or manually variable fan blades or airfoils which will encounter these aforementioned large variations in back pressure resulting in large variations in apparent angle-of-attack of the blades. For a selected blade pitch the blade airfoil will stall aerodynamically with too much back pressure, and thereby cease to provide the aerodynamic lift that provides air flow. Conversely, with little or no back pressure, the impeller blade airfoils are inefficient, and drive power is wasted and over speed may occur. The overall effect of airfoil stall and other unsteady mechanisms, such as fan flow hysteresis (non-linear response), is a reduction in fan performance efficiency. In other words, it takes a while for the blade airfoils to recover from the stall to become effective again.

SUMMARY OF THE INVENTION

Briefly, the instant invention overcomes the disadvantages of the prior art fixed-blade fan impellers by providing an impeller having automatically variable pitch blades. The use of this variable-pitch blade system is in an unsteady flow regime.

Airfoil-shaped blades are affixed for rotation about their axes to a hub mounted for axial sliding motion on a drive shaft. Inside the hub each blade at its inner end has an eccentric pin with a link connected thereto. The other end of the link is connected to the drive shaft at a pin affixed thereto. The hub and shaft are connected through a bearing mechanism which permits the hub to have relative axial motion along the longitudinal axis of the shaft, but prohibits relative rotational movement. As the hub moves axially, a rotational movement is transmitted through the pin and link arrangements to the fan blades to vary their pitch. This axial motion is resisted by properly designed springs and dash-pots to produce, in a non-linear fashion, the exact pressure/pitch relationship required to optimize the lift/drag behavior of the fan impeller blades.

STATEMENT OF THE OBJECTS OF THE INVENTION

Accordingly, an object of the invention is to provide a new, improved, and efficient axial fan impeller.

Another object of the instant invention is to provide a variable-pitch blade impeller for axial fans.

A further object of the instant invention is to provide an automatically variable pitch blade impeller to accommodate varying back-pressure.

BRIEF DESCRIPTION OF THE DRAWINGS

Other objects, advantages, and novel features of the invention will become apparent from the following detailed description of the invention, when considered in conjunction with the accompanying drawings wherein:

FIG. 1 is a side elevation view, partially cut away, of the axial fan with automatically controlled, variable pitch blades;

FIG. 2 is a side elevation view taken along line 2—2 showing the eccentric pin and link connection of the blade to the drive shaft;

FIG. 3 is a cross-sectional view, taken along line 3—3 showing the hub-to-shaft bearing and spline arrangement; and FIG. 4 is a cross-sectional view taken across line 4—4 showing the blade airfoil shape.

DESCRIPTION OF THE PREFERRED EMBODIMENT

Referring now to the drawings, wherein like reference numerals refer to the same item throughout the several views, there is shown generally, in FIG. 1, a fan impeller 10, having a hub 12, a drive shaft 14 connected within the hub, and a plurality of radially extending blades 16.

The hub 12 retains the blades 16 for rotation about their axes with thrust bearings 18, which may be of the tapered roller bearing type, as shown. Referring also to FIG. 4 the blades have an airfoil shaped cross-section portion 20 radially outward to their tips (not shown) for causing fluid flow.

Attached to the innermost end of each blade 16, is a thrust collar 22 having an eccentric pin 24 affixed on the inner face and directed inwardly.

Referring to both FIG. 1 and FIG. 2, one end of a connecting link 26 fits on the eccentric pin 24, and at its other end, the connecting link fits on a drive shaft pin 28 affixed to the drive shaft 14. Both line-to-pin fittings allow rotary motion, much like a crank shaft, connecting rod, and piston wrist-pin arrangement. Thus the blades 16 are attached, in different ways, to both the hub 12 and to the drive shaft 14.

Referring now to FIG. 3 which shows a transverse cross-section of the hub 12 and the shaft 14 in mating relationship, there is shown splines 30 on the inside diameter of the hub, and splines 32 on the outside diameter of the drive shaft. A plurality steel bearing balls 34 are interposed between the splines 30 and 32 to complete the mating relationship. Thus the hub is free to move along the axis of the shaft, but is prohibited from relative rotation with respect to the shaft. It is to be understood that only one layer of balls is shown, but many may be placed along the splines.

Referring back now to FIG. 1, the restoring force unit 36 is shown in detail. The force unit 36 comprises springs 38 acting in compression axially between the hub and the shaft. The shaft has an annular groove therein forming seats 40 for the springs 38, and the hub has an inwardly extending annular ring 42 forming seats 44 for the other ends of the springs. The springs are thus in reservoirs 45 and 46, defined by the groove and annular ring, which also contain oil, sealed in by "O"-ring seals 48, or the like, in sliding and sealing relationship between the hub and the drive shaft in three places, as shown. A restricting orifice 50 is formed axially through the annular ring 42, making a passage between the reservoirs 46. The entire axial fan assembly discussed above may be encompassed by an annular shroud (not shown) having a diameter slightly larger the blade tip-to-tip diameter.

The operation of the axial fan with automatically controlled, variable pitch blades, is as follows:

A rotary driving force (not shown) is applied to the shaft 14 rotating it and the hub 12 in unison, due to the prohibited relative rotation feature.

At operating speed, the axial fan impeller 10 pumps air or develops air flow due to the blades' airfoil configuration. It is to be understood that the impeller could be oriented in any direction and be shrouded or unshrouded, and therefore might be even used as an aircraft propeller.

The impeller develops a pressure differential and where the back pressure can change drastically and quickly this impeller is most effective. Changes in back pressure result in wind vector changes which amounts to changes in blade angle-of-attack. In particular when the back pressure increases, the blades' 16 plane of rotation 17 is caused to move away from the higher back pressure. The hub 12, because the blades are attached thereto, is also forced away and slides axially along the spline-bearing ball assembly on the shaft 14. The relative axial motion of the hub 12 on the shaft 14 is resisted by the restoring force unit 36. During this hub and blade plane movements, the eccentric pins 24, affixed to each blade 16, are held from movement because they are connected through links 26 to the drive shaft pins 28 affixed to the drive shaft 14, which is fixed axially. Therefore the blades 16 are forced to rotate on their thrust bearings 18 about their own axis to feather. Feathering during higher back pressures lessens the blade's angle-of-attack, thus inhibiting stall of the blades' airfoil 20. When the back pressure is reduced, the blades' plane of rotation, and thereby the hub, moves back toward this lesser back pressure axially along the shaft, and the links 26 and pins 24 and 28 force the blades 16 and airfoils 20 to rotate to a higher angle-of-attack, thus providing greater efficiency and less over speed. The relative axial motion of the hub 12 on the shaft 14 is again resisted by the restoring force unit 36, to be explained hereinafter.

The restoring force unit 36, formed by springs 38, spring-bias the hub and therefore the blade pitch to a predetermined position. Along with the springs 38 in reservoirs 46, is the oil which may slowly flow through a restricting orifice 52 between the reservoirs when relative axial motion occurs thus providing a dash-pot damping action. Thus the combination of the springs and dash-pots provide a designed non-linear restoring force to blade airfoil pitch or angle-of-attack, to achieve an equilibrium pitch angle to compensate for non-linear blade exitation. This optimizes the lift/drag behavior of the blade airfoils in an unsteady back pressure and flow regime. Further this novel combination results in quick response, thus alleviating the common detrimental non-linear hysteresis problem of unsteady flow regime operation.

Obviously, many modifications and variations of the present invention are possible in the light of the above teachings. It is therefore to be understood that within the scope of the appended claims, the invention may be practiced otherwise than as specifically described.

What is claimed is:

1. An axial fan with automatically controlled variable pitch blade comprising:

a rotatable drive shaft;

an axially slidable hub connected to said drive shaft for rotation therewith;

a plurality of airfoil blades attached to said hub;

said blades being rotatable about their respective axes;

means to adjust said blade in pitch in response to movement of said hub, said movement of said hub being responsive to variations in blade pressure;

means mounted to resist the movement of said hub;

said means to resist the movement of said hub including an annular groove in said shaft and an annular ring on said hub extending into said groove;

at least one pair of springs positioned between the side walls of the groove and the side walls of the ring in opposed relationship whereby the axial motion of the hub relative to the shaft is opposed.

2. A fan as claimed in claim 1 in which said ring divides the groove into two chambers;

said chambers being filled with a fluid;

said ring having at least one orifice extending through said ring to connect the two chambers;

said ring and said hub being in sliding and sealing relation to said groove.

3. A fan as claimed in claim 2 in which said fluid is an oil.

* * * * *